United States Patent [19]

Estienne

[11] Patent Number: 4,595,047

[45] Date of Patent: Jun. 17, 1986

[54] DEVICE FOR ATTACHING AN ELEMENT FOR ROTATION IN A TUBE

[75] Inventor: Patrick Estienne, Vernouillet, France

[73] Assignee: Elf France, Paris, France

[21] Appl. No.: 669,100

[22] Filed: Nov. 7, 1984

[30] Foreign Application Priority Data

Nov. 9, 1983 [FR] France ..... 83 17820

[51] Int. Cl.[4] ..... F28G 3/00; F28G 15/08

[52] U.S. Cl. ..... 165/76; 15/104.06 R; 138/108; 165/85; 165/94; 165/95; 165/109.1

[58] Field of Search ..... 138/108; 165/76, 85, 165/109.1, 94, 95; 15/104.06 R, 104.09

[56] References Cited

U.S. PATENT DOCUMENTS

| | | | |
|---|---|---|---|
| 4,069,535 | 1/1978 | Cato | 15/104.06 R |
| 4,081,875 | 4/1978 | Nishino | 15/104.06 R |
| 4,174,750 | 11/1979 | Nichols | 165/94 |
| 4,425,385 | 1/1984 | Coulter et al. | 427/238 |
| 4,473,921 | 10/1984 | Weber et al. | 15/104.09 X |

*Primary Examiner*—Sheldon J. Richter

*Attorney, Agent, or Firm*—Weiser & Stapler

[57] ABSTRACT

A device for attaching an element for rotation in a tube comprises a conical sleeve, a hook and a link-pin. The link-pin interconnects the hook and the sleeve while permitting rotation of the hook. A particular application of the attachment device is to position an Archimedes' screw in the tubes of a multitubular heat exchanger, a steam condensor or the like. The assembly can be dismounted, if desired, and is adaptable to different tube diameters.

18 Claims, 10 Drawing Figures

FIG. 4
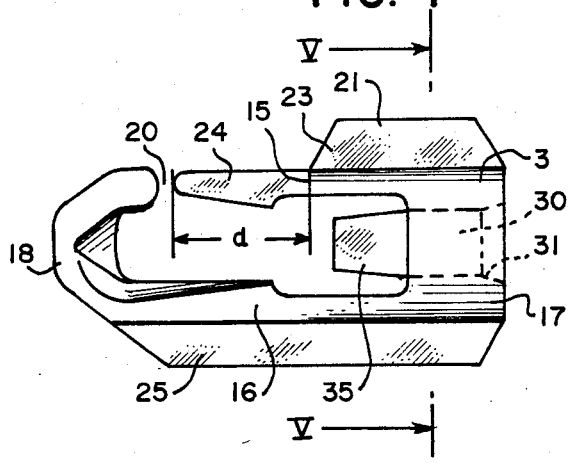
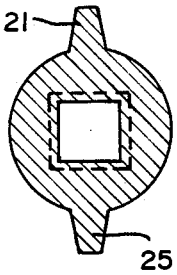
FIG. 5
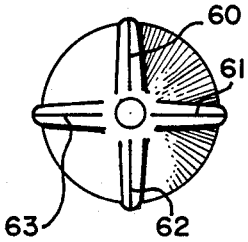
FIG. 7
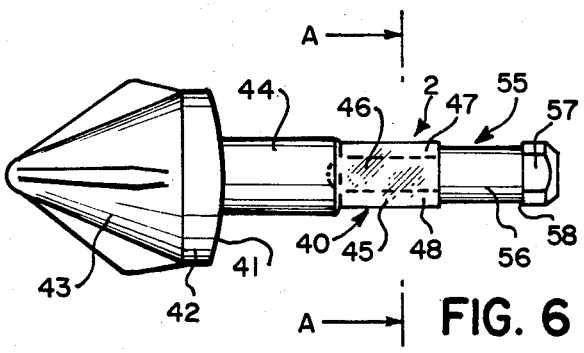
FIG. 6
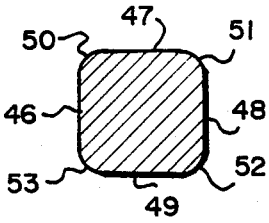
FIG. 6a FIG. 8
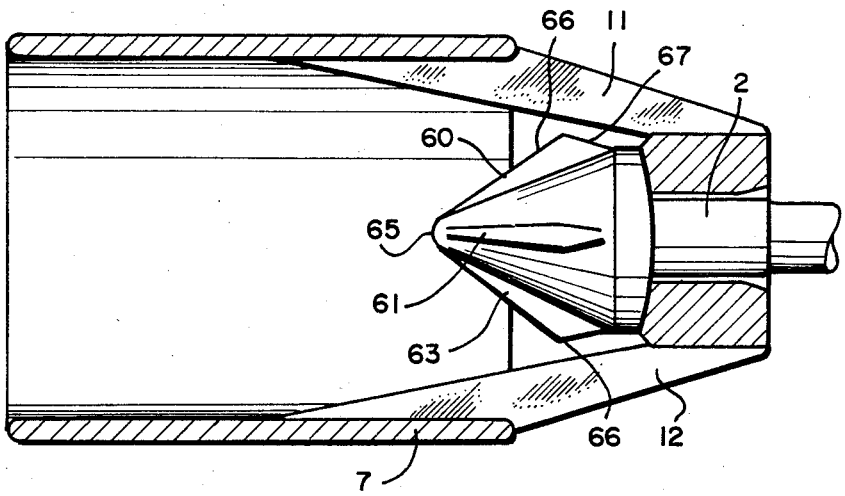
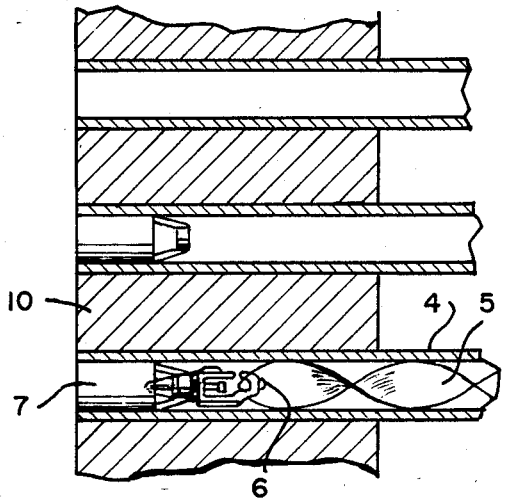
FIG. 9

DEVICE FOR ATTACHING AN ELEMENT FOR ROTATION IN A TUBE

BACKGROUND OF THE INVENTION

1. Field of the Invention

The present invention concerns a device which is capable of securing an element for rotation within a tube or cylinder such as, for example, an elongate tube of a multitubular heat exchanger, a steam condenser, or the like.

2. Description of the Related Art

Devices are known which are capable of continuously cleaning the internal surfaces of such tubes so as to improve heat transfer by reducing the thickness of the laminar layer which is in contact with the inner walls of the tube, as well as by increasing the Reynolds number. One such device makes use of an Archimedes' screw which is mounted for rotation in the tube responsive to the circulation of fluid through the tube. Such a device is disclosed, for example, in U.S. Pat. No. 4,174,750. According to this patent, an Archimedes' screw is retained in the tube of a heat exchanger by a swivel mounting which is secured in place by a hollow stopper comprised of a bearing flange and a support constituted by a metallic wire. The support is generally V-shaped, with its legs inserted in the flange of the stopper and its tip forming a hooking ring for securing a conventional swivel to the support.

This method of attachment has been found to present several drawbacks, one particular drawback being projection of the attachment from the plate which is used to secure the tubes in desired position (the tube plate); as a result of the bearing flange of the stopper resting on the tube plate, and projection of at least portions of the swivel from the bearing flange in view of its attachment to the apex of the V-shaped support. Projection of the attachment from the tube plate prohibits the use of such Archimedes' screws with devices which must move across the tube plate, such as inspection devices for verifying that the connection between each of the tubes and the tube plate remains waterproof, since the surface of the tube plate must be smooth for such operations to proceed.

It is therefore a primary objective of the present invention to provide a device which is capable of attaching an element for rotation in a tube without in any way projecting from the adjacent tube plate.

Another drawback encountered in the use of such attachment devices arises when the fluid (generally water) circulating inside the tubes is not completely free of impurities, but rather contains, for example, vegetable waste. These impurities can collect on the swivel (hook) or the support wire, eventually limiting the passage of fluid and/or inhibiting rotation of the cleaning device either mechanically, or by blocking the mouth of the tube.

It is therefore another objective of the present invention to provide a self-cleaning attachment device, which will accommodate vegetable or other wastes which are present in the fluid circulating inside the tubes.

A further objective of the present invention is to provide an attachment device which allows the effect of the Archimedes' screw to reach even the mouth of the tube, by ensuring appropriate turbulence even in those portions of the tube which do not actually contain a portion of the Archimedes' screw, so as to prevent the clogging of such regions as well.

A further objective of the present invention is also to provide an attachment device which is simply and rapidly assembled, even in connection with industrial applications wherein large series of tubes (up to 100,000 pieces) are combined in a single apparatus.

SUMMARY OF THE INVENTION

These various objects are achieved by an attachment device according to the present invention which comprises:

- a tapered sleeve which is capable of being force fit into the end of a tube and which is provided with a fixed annular bearing associated with the sleeve by means of at least two arms inclined toward the bearing;
- a flat hook comprised of first and second lateral legs associated with each other by a major limb and a minor limb, wherein the major limb is provided with an issuing bore and at least one flexible ratching tongue in substantial alignment with and extending from the bore, and the first lateral leg is provided with an opening; and
- a link-pin connecting the sleeve and the hook while allowing the hook to rotate about its axis, wherein one end of the link-pin is provided with an annular bearing surface and the other end of the link-pin is provided with at least one lateral slot, and wherein the link-pin is engaged, on one hand, in the annular bearing of the sleeve, and on the other hand, in the bore of the hook such that the ratchet is pressed against the slot.

As a further characteristic of the present invention, the bore of the major limb of the hook and the axle of the link-pin each incorporate at least one planar surface, which surfaces face one another when the hook and the sleeve are interconnected by means of the link-pin. Further, the annular bearing surface of the link-pin forms the base of a cone which is coaxial with the axle of the link-pin, which cone is provided with at least one radial vane.

As a further characteristic of the present invention, the second lateral leg of the hook comprises a longitudinal, external flange.

BRIEF DESCRIPTION OF THE DRAWINGS

Other features, objects and advantages of the invention will become apparent from the following detailed description of a preferred embodiment attachment device in accordance with the present invention, which is provided as a non-limiting illustration with reference to the appended drawings in which:

FIG. 4 is an elevational view of the hook of the device;

FIG. 5 is a sectional view of the hook, taken along line V—V of FIG. 4;

FIG. 6 is an elevational view of the link-pin of the device;

FIG. 6*a* is a sectional view of the link-pin, taken along line A—A of FIG. 6;

FIG. 7 is an end view of the link-pin as viewed from the fluid input side of the device;

FIG. 8 is a view similar to that of FIG. 2, but with the link-pin in position on the bearing; and FIG. 9 is a partial, sectional view of an assembly of tubes provided with attachment devices according to the present invention.

BRIEF DESCRIPTION OF THE PREFERRED EMBODIMENT

Figure 1:
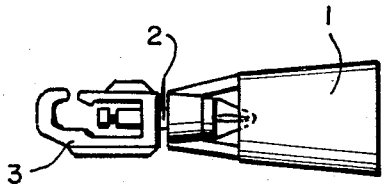
FIG. 1 is an elevational view of an attachment device according to the present invention.
Figure 2:
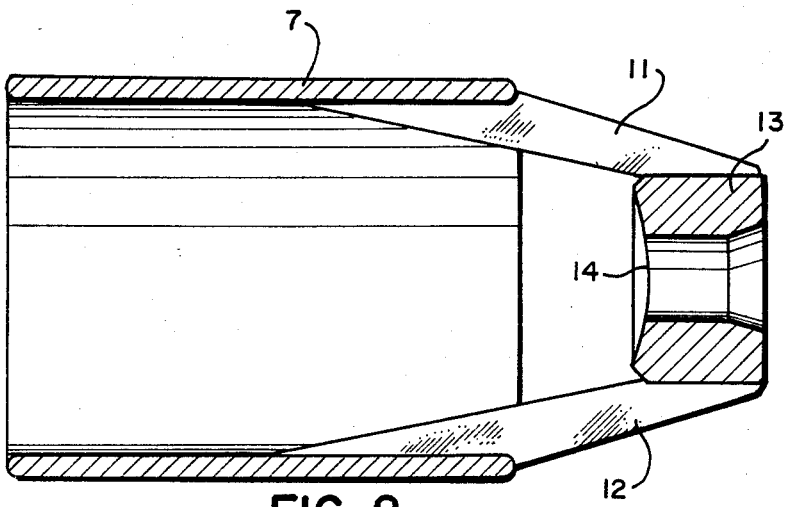
FIG. 2 is a sectional view of the sleeve of the device.
Figure 3:
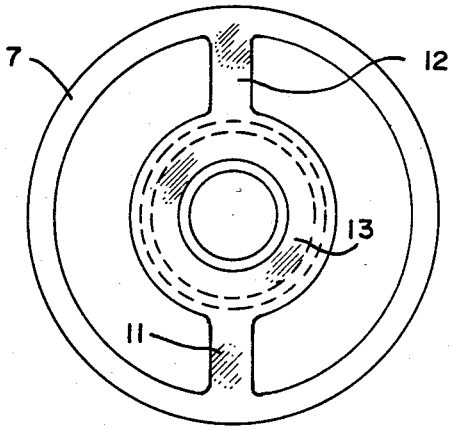
FIG. 3 is an end view of the sleeve of the device as viewed from the fluid outlet side of the device.

The attachment device represented in FIG. 1 generally comprises a carrier 1, a link-pin 2 and a hook 3, and is intended to be introduced into a tube 4 (as shown in FIG. 9) in order to secure a conventional spiral 5 to the end of the hook 3 by engaging an opening 6 in the spiral 5.

The carrier 1 preferably takes the form of a tapered (conical) sleeve 7 which is configured to be fitted inside the tube 4, for example, by using a mallet. The outer dimensions of the sleeve 7 are selected so as to allow the carrier 1 to be secured in the tube 4 simply by means of a force fit between the relatively flexible material constituting the sleeve 7 and the inner walls of the tube 4.

A pair of arms 11 and 12 connect the sleeve to an annular bearing 13, the bearing surface 14 of which is generally spherical. Arms 11 and 12 are configured so as to be capable of withstanding the stresses to which the bearing 13 is subjected, while presenting an oval passageway which allows an improved fluid flow.

FIG. 4 shows the hook 3, which generally comprises two lateral legs 15 and 16 which are associated with one another by a major limb 17 and a minor limb 18. The major limb 17 is generally cylindrical and the lateral legs 15 and 16 take the form of cylindrical segments which are coaxial with the major limb 17. The lateral leg 15 is provided with an opening 20 situated adjacent to the minor limb 18, and a flange 21 having a trapezoidal section and extending from the rear face of the major limb 17 to a distance (d) from the opening 20. The portion of the lateral leg 15 which is located between the opening 20 and the nearest end 23 of flange 21 is formed of a flexible material and defines a flexible tongue 24 of a length (d). The lateral leg 16 is also provided with a flange 25 having the same trapezoidal section as flange 21, and extending along the length of the leg 16. Thus, the minor limb 18, the flexible tongue 24 of the lateral leg 15, and the lateral leg 16 combine to define a region for hooking the spiral 5 as previously described.

The major limb 17 of the hook 3 further comprises a bore 30 having a square cross section and terminating in a frustrum of a pyramid 31. Level with the face of the bore 30, the major limb 17 is provided with two tongues, only one of which is visible in FIG. 4 (indicated at 35).

The link-pin 2 is shown in FIGS. 6 and 7, and generally comprises an axle 40, a bearing surface 41 forming the end of a cylinder 42, and a conical portion 43.

The axle 40 is divided into four parts. Part 44 is a cylindrical member which is integral with the bearing surface 41 and which has a length at least equal to the length of the annular bearing 13. The diameter of the cylindrical portion 44 is slightly smaller than the diameter of the annular bearing 13.

The cylindrical portion 44 is in turn connected to an intermediate portion 45 having a somewhat octagonal section (See FIG. 6*a*) which is developed by four planar walls 46, 47, 48 and 49 separated by four slightly rounded corners 50, 51, 52 and 53. The thickness of the intermediate portion 45 is substantially equal to the width of the bore 30, and its length is slightly greater than the length of said bore 30.

The axle 40 terminates in a ratchet portion 55 comprised of a cylindrical extension 56 and an octagonal lug 57 which defines a lateral slot at 58. The length of the spindle 56 is equal to that of the tongues 35.

The bearing surface 41 takes the form of a spherical ring which complements the bearing surface 14 of the annular bearing 13, and forms part of a cylindrical wearing disc 42 to which is mounted a cone 43. The base of the cone 43 has the same diameter as the disc 42. The face of the cone 43 is provided with four vanes 60, 61, 62 and 63 (See FIG. 7) which extend fully along four orthogonal generatrix lines. Each vane takes the form of a triangle, the longer side of which is associated with a generatrix line of the cone 43, and the shorter side of which is oriented toward the base of the cone 43. The respective dimensions of these elements appear clearly in FIG. 6.

FIG. 8 shows portions of the link-pin 2 in the assembled position. The apex 65 of the cone 43 is situated within the sleeve 7. The peaks 66 of the vanes are situated opposite central portions of the arms 11 and 12 such that the smaller sides 67 of the vanes are substantially parallel to the arms 11 and 12. The longer sides of the vanes extend between the apex 65 of the cone and the apex 66 of the triangle.

The positioning and operating of the device represented hereinabove are as follows.

A sleeve 7 is selected having outer dimensions which are compatible with the inner dimensions of the tube 4 into which it is to be inserted. It is, indeed, an advantage of the attachment device of the present invention to be capable of installation in tubes of different diameters since it is possible to provide carriers 1 having sleeves 7 of different size, but which incorporate bearings 13, arms 11 and 12, link-pins 2 and hooks 3 which are uniform in size.

The link-pin 2 is introduced into the bearing 13, and in turn into the bore 30 of the hook 3. The resulting assembly is maintained in position as a result of interaction between the tongues 35 and the lateral slot 58 of the octagonal lug 57. The spiral 5 is then fixed to the hook 3, and the assembly is introduced and then force fit into the tube 4. In this regard, the assembly is inserted into the tube 4 until the entire sleeve 7 is introduced into the tube 4, so that no part of the device projects from the tube plate 10 in which the tubes 4 are seated.

In operation, a fluid will circulate in each tube 4 from its upstream toward its downstream end, i.e. from the end of the tube which is integral with the tube plate 10. Passage of this fluid initiates rotation of the Archimedes' screw 5. In a manner which is known per se, rotation of the screw 5 serves to continuously clean the internal surface of the tube and to improve heat transfer by reducing the thickness of the laminar layer in contact with the internal walls of the tubes, as well as by increasing the Reynolds number. Rotation of the Archimedes' screw is transmitted to the link-pin 2 since the link-pin 2 and the hook 3 incorporate cooperating prismatic surfaces, namely the walls of the square bore 30 and the walls 46, 47, 48 and 49 of the intermediate portion 45 of the axle 40. The vanes 61, 62, 63 and 64 are thus also caused to rotate.

As previously indicated, it is possible for the fluid which circulates in the tube 4 to contain different substances in suspension, in particular, vegetable waste. The device according to the present invention serves to prevent this waste from clogging the tube 4 at its inlet (i.e. at the hooking point of the Archimedes' screw), an obstruction which could arise, for example, from the entrainment of such waste by the arms 11 and 12. However, due to the inclined orientation of the arms 11 and 12, any such vegetable waste is eventually directed toward the base of the cone 43, opposite the shorter sides 67 of the vanes. The empty space between the arms 11 and 12 and the volume generated by the vanes during their rotation, in particular, by rotation of the shorter sides 67, is sufficient to put these particles back into circulation by tearing them from the arms 11 and 12.

The fluid can also contain other substances in suspension, in particular, abrasive particles, which could damage the bearing surfaces of the bearing 13 and the link-pin 2. Such particles are evacuated, toward the outside of the bearing 7, on the one hand due to the conical shape of the end portion of the link-pin (the cone 43), and on the other hand due to the centrifugal effect developed by rotation of the vanes. A self-cleaning device is thus realized.

As previously indicated, the lateral legs 15 and 16 of the hook 3 are provided with flanges 21 and 25 that serve to strengthen the hook 3 and thus prevent its deformation. These flanges also provide a complementary function, that being the generation of turbulence in the region between the bearing 13 and the upstream end of the screw. Such turbulence serves to reduce to the extent possible the length of the tube 4 which is not subjected to the foregoing cleaning effects. Furthermore, in cases where the thickness of the tube plate is such that portions of the tube are situated opposite the vanes so as to contribute to heat exchange, the performance of this exchange is further improved.

It will also be noted that the above-described device ensures proper maintenance of the Archimedes' screw, even in situations where the direction of circulation of the fluid is reversed. This is due to the presence of the flexible tongue 24, which allows manual hooking of the screw while preventing unhooking of the screw during counter-circulation of the fluid. Thus, the flexible tongue 24 provides supplementary security against unhooking of the Archimedes' screw since, being positioned in the tube and fixed to the device, the Archimedes' screw cannot become detached since the hook remains centered in the tube by operation of the sleeve.

It is to be understood that the present invention is not limited to the embodiment described above; but rather also includes all variants thereof. For example, the flanges 21 and 25 fixed to the lateral legs of the hook could also have a spiral form with, for example, the same pitch as the Archimedes' screw. The same is true regarding the shape and number of the vanes 60, 61, 62 and 63, so long as the vanes provided ensure, during their rotation, that particles deposited on the inclined arms of the carrier will be returned to the circulating fluid as previously described.

The device described above presents the further advantage of being capable of manufacture by pressure molding techniques since each component is capable of such construction. The materials used in forming the various components are preferably plastics, but can also be composites or non-plastic materials. If desired, additives may be mixed with the materials used, their properties being chosen in accordance with the particular application involved. In a preferred embodiment, the sleeve and the hook are formed of a polyacetate, while the link-pin is a polyacetate within which is mixed molybdenum bisulphide.

What is claimed is:

1. Device for attaching an element for rotation in a tube, which comprises:

a tapered sleeve adapted for frictional engagement in said tube and including a fixed annular bearing, said bearing being associated with said sleeve by at least two arms, and said arms being inclined toward said bearing;

a hook including at least first and second lateral legs associated with each other by a major limb and a minor limb, said major limb being provided with an open bore and at least one flexible ratching tongue extending from said bore, and said first lateral leg being provided with an opening; and a link-pin for interconnecting said hook and said sleeve while allowing the hook to rotate about its axis, wherein one end of the link-pin is provided with an annular bearing surface and the other end of the link-pin is provided with at least one lateral slot, and wherein portions of said link-pin are engaged in the annular bearing of said sleeve and other portions of said link-pin are engaged in the bore of said hook such that said ratching tongue is pressed in said lateral slot.

2. Device according to claim 1, wherein said tapered sleeve is generally conical in shape.

3. Device according to claim 1, wherein said annular bearing has an essentially spherical bearing surface.

4. Device according to claim 3, wherein the annular bearing surface of said link-pin is essentially spherical.

5. Device according to claim 1, wherein said hook rotates on an axle, and wherein the bore of said hook and a flange of said axle each comprise a planar surface, which planar surfaces are situated opposite one another when the hook and the sleeve are interconnected by the link-pin.

6. Device according to claim 1, wherein said annular bearing surface is integral with the base of a coaxial cone associated with said axle.

7. Device according to claim 6, wherein the surface of said cone is provided with at least one radial vane.

8. Device according to claim 7, wherein a series of four vanes are located on orthogonal generatrix lines of said cone.

9. Device according to claim 7, wherein said vane is triangular, and wherein one side of said vane has substantially the same inclination as the connecting arms of said sleeve.

10. Device according to claim 6, wherein a cylinder is interposed between said annular bearing surface and the base of said cone.

11. Device according to claim 6, wherein the apex of said cone is positioned inside of said sleeve.

12. Device according to claim 1, wherein the second lateral leg comprises a longitudinal, external flange.

13. Device according to claim 12, wherein an external flange extends along portions of said first lateral leg.

14. Device according to claim 13, wherein said first lateral leg incorporates a flexible tongue extending between said opening and said external flange.

15. Device according to claim 1, wherein said first lateral leg incorporates a flexible tongue adjacent to said opening.

16. Device according to claim 15, wherein said minor limb, said flexible tongue and said second lateral leg form an enclosure for engaging portions of said element.

17. Device according to claim 1, wherein a pair of ratching tongues extend from opposite sides of said bore, and wherein said ratching tongues combine to engage the lateral slot of said link-pin.

18. Device according to claim 1, wherein the sleeve and the hook are formed of a polyacetate and the link-pin is formed of a polyacetate within which is mixed molybdenum bisulphide.

* * * * *